United States Patent [19]

Struble et al.

[11] Patent Number: 4,949,885

[45] Date of Patent: Aug. 21, 1990

[54] APPARATUS AND METHOD FOR CONTAINING INERT GAS AROUND MOLTEN METAL STREAM

[75] Inventors: Ronald G. Struble, Hebron; James P. Iwinski, Lowell, both of Ind.

[73] Assignee: Inland Steel Company, Chicago, Ill.

[21] Appl. No.: 314,822

[22] Filed: Feb. 23, 1989

[51] Int. Cl.[5] ..... B22D 41/58

[52] U.S. Cl. ..... 222/590; 222/606; 222/603

[58] Field of Search ..... 222/590, 603, 606, 607

[56] References Cited

U.S. PATENT DOCUMENTS 4,480,770 11/1984 Goursat et al. ..... 222/603

4,747,584 5/1988 Rellis, Jr. et al. ..... 266/287

4,854,487 8/1989 Ando et al. ..... 222/606

FOREIGN PATENT DOCUMENTS 2607735 8/1977 Fed. Rep. of Germany .

*Primary Examiner*—S. Kastler

*Attorney, Agent, or Firm*—Marshall, O'Toole, Gerstein, Murray & Bicknell

[57] ABSTRACT

A molten metal stream descends from a ladle through a nozzle and then a shroud into a molten metal bath in a tundish. Structure is provided to contain a ring of inert gas around the nozzle immediately adjacent the junction of the nozzle and the shroud and to prevent outside air from entering the shroud at the junction.

24 Claims, 3 Drawing Sheets

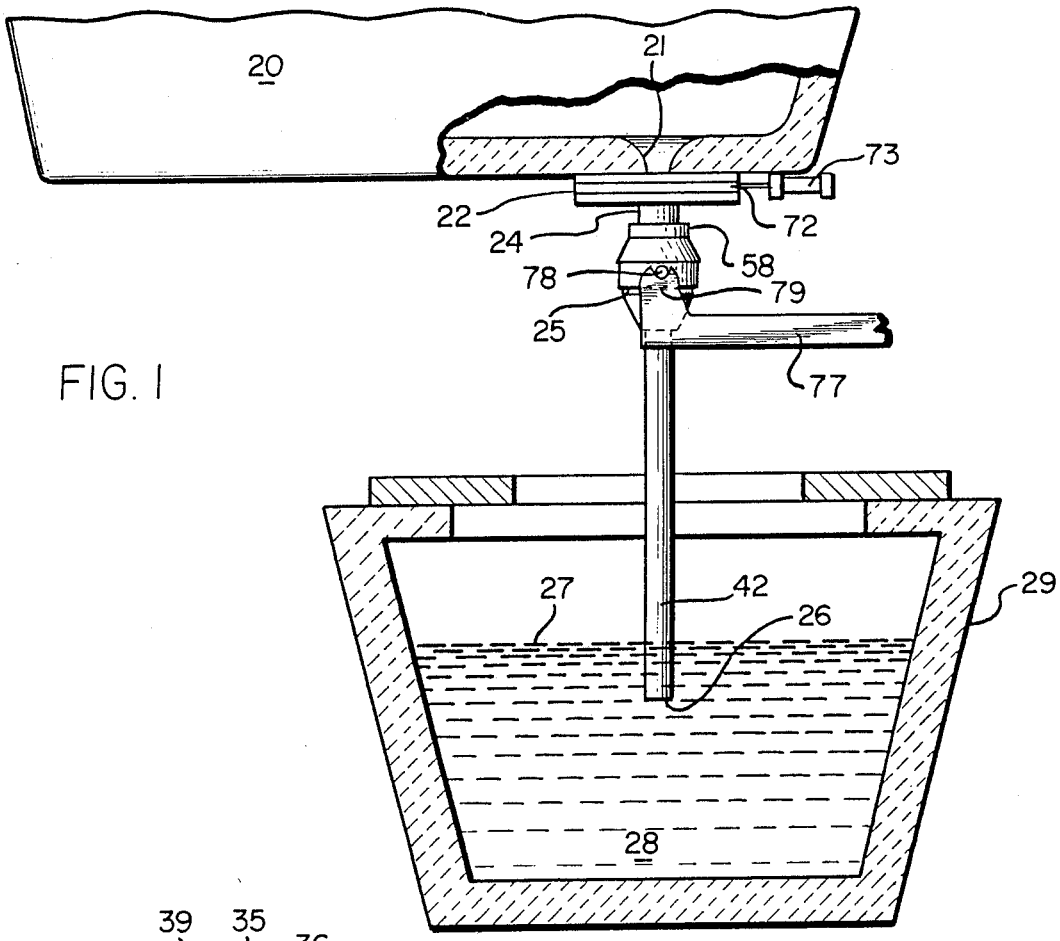
FIG. 1
FIG. 2
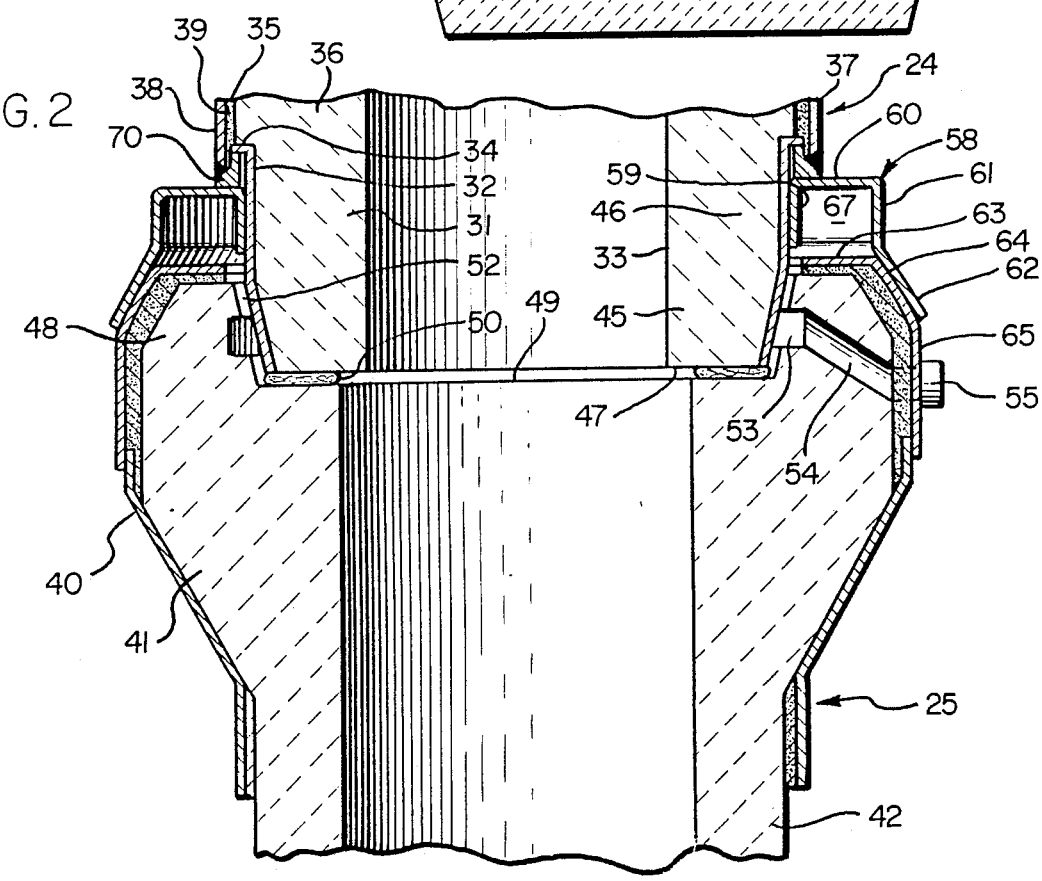

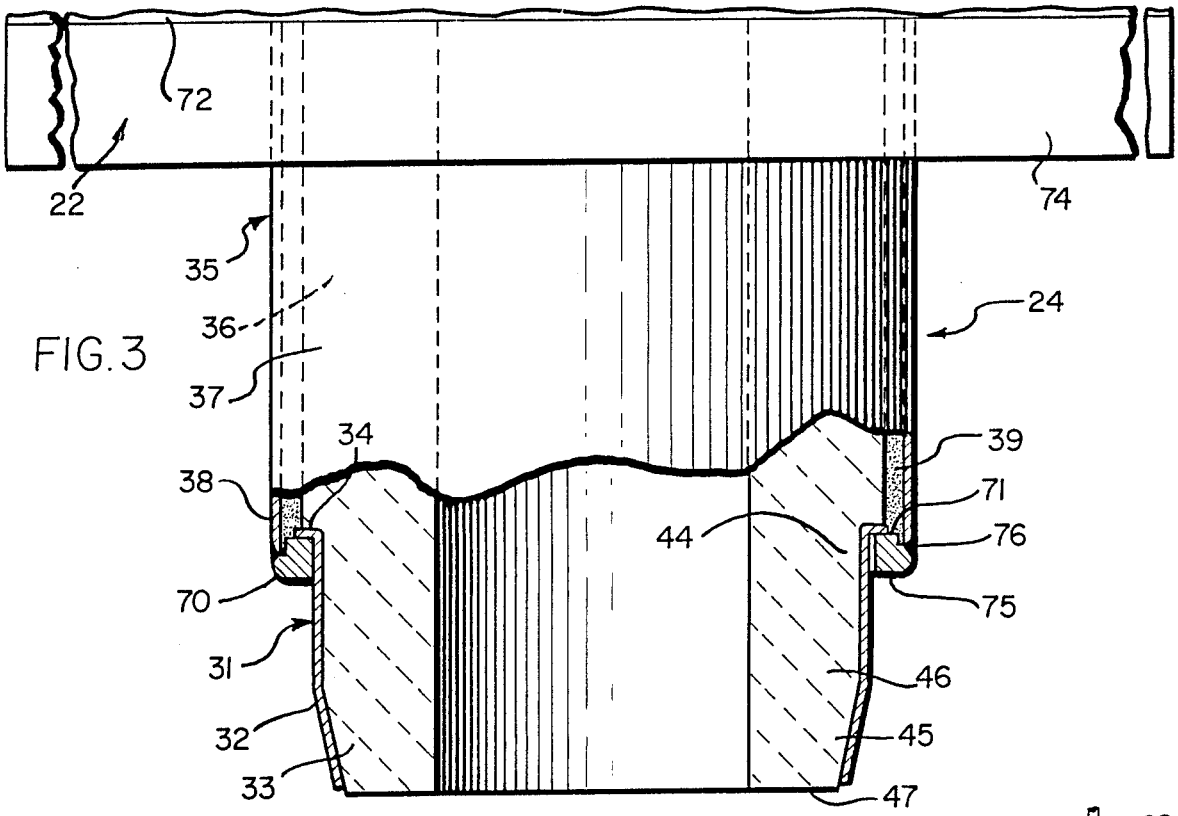
FIG. 3
FIG. 5
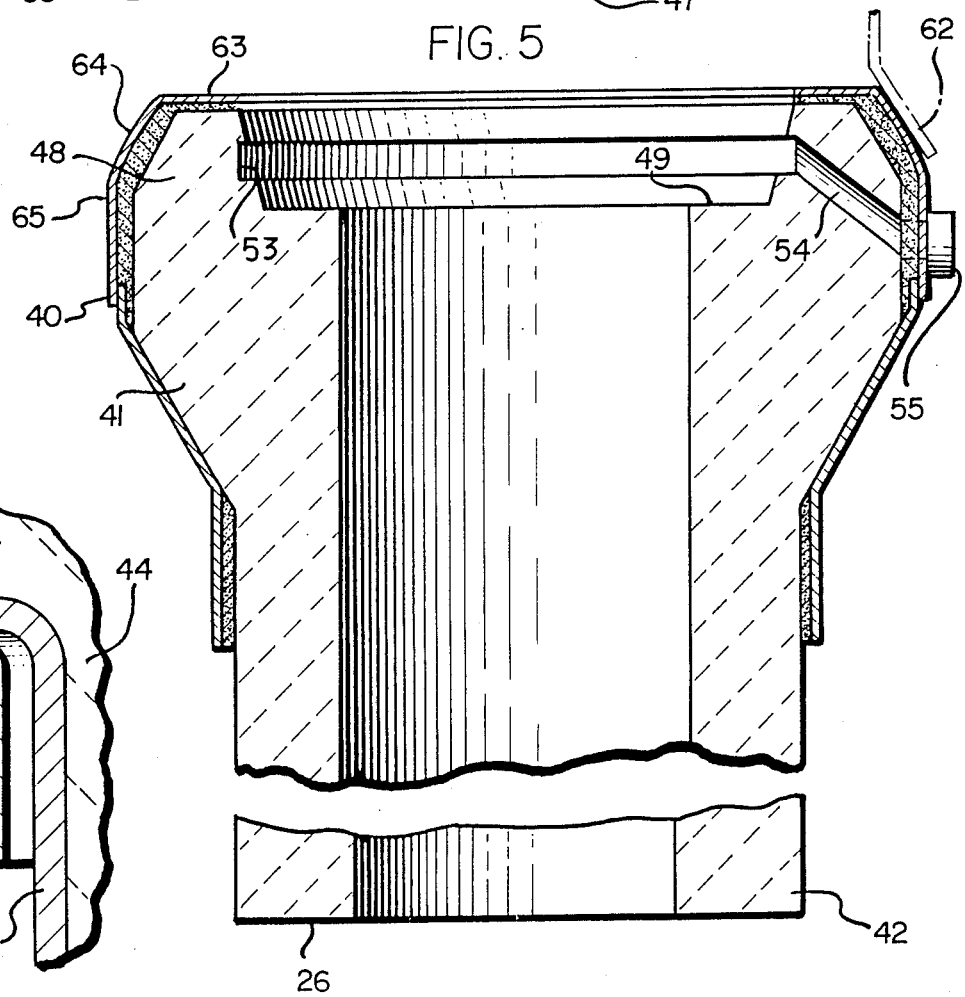
FIG. 4
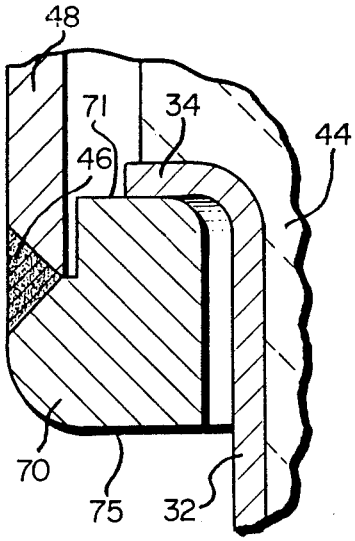

APPARATUS AND METHOD FOR CONTAINING INERT GAS AROUND MOLTEN METAL STREAM

BACKGROUND OF THE INVENTION

The present invention relates generally to methods and apparatuses for handling a stream of molten metal and more particularly to methods and apparatuses for preventing the entry into the molten metal stream of gas from the surrounding atmosphere.

In conventional casting operations, a vertically descending stream of molten metal (e.g., molten steel) flows from an upper container such as a ladle to a lower container such as the tundish of a continuous casting apparatus. The stream typically flows through a vertically disposed nozzle having an upper end communicating with a bottom outlet from the ladle and a lower end disposed above the top surface of a molten metal bath in the lower container, e.g., the tundish. In the absence of protective measures, that portion of the molten metal stream between the lower end of the nozzle and the top of the molten metal bath is exposed to the outside atmosphere surrounding the stream, e.g., air. In such a case, air can be absorbed into the stream which is undesirable because it introduces oxygen and nitrogen as impurities into the molten metal. To prevent this from occurring, it has been conventional to enclose that part of the descending metal stream, below the lower end of the nozzle, within a vertically disposed, tubular shroud having a lower end submerged within the molten metal bath in the lower container.

The shroud is aligned with the nozzle and has an upper portion which surrounds and removably engages the lower portion of the nozzle at a junction of the two. The interior of the tubular shroud typically has a cross-sectional area (or diameter) greater than the cross-sectional area (or diameter) of the nozzle's interior. Because the shroud has a larger interior cross-section than the nozzle, a descending molten metal stream which fills the entire interior cross-section of the nozzle will not fill the entire interior cross-section of the shroud. As a result, the molten metal stream descending from the nozzle through the interior of the shroud will create a partial vacuum in the shroud. There is a seam where the upper portion of the shroud removably engages the lower portion of the nozzle at their junction, and the partial vacuum created within the interior of the shroud has a tendency to aspirate outside air from the atmosphere surrounding the shroud and the nozzle into the interior of the shroud through the seam at the junction. This is undesirable because it will introduce oxygen and nitrogen into the molten metal stream.

Attempts have been made in the past to prevent outside air from being aspirated into the interior of the shroud, but none of these attempts has been sufficiently successful. For example, in one attempt, an annular clearance was provided between the upper portion of the shroud and the lower portion of the nozzle, at the location of the seam, and an inert gas, such as argon, was continuously introduced into the clearance to exclude air from entering the clearance. The inert gas was drawn from the clearance into the shroud by the partial vacuum in the shroud, and this necessitated replenishment of the inert gas in the clearance.

A problem with the expedient described above was the occurrence of eddy currents in the inert gas in the clearance. This allowed the periodic escape of the inert gas from the clearance to the atmosphere and the entry of outside air into the clearance. This air was drawn from the clearance into the interior of the shroud where it could mix with the descending stream of molten metal. In addition, the escape of the inert gas to the atmosphere was wasteful and necessitated too great a replenishment of the inert gas in the clearance.

SUMMARY OF THE INVENTION

The drawbacks and defects in the attempts described above are overcome by a method and apparatus in accordance with the present invention. In addition to providing an inert gas in the clearance between the upper portion of the shroud and the lower portion of the nozzle, the present invention provides a ring of inert gas around the nozzle above the clearance and immediately adjacent the junction. This ring of inert gas communicates with the gas in the clearance, and the pressure of the inert gas in the ring is maintained over the pressure of the atmosphere outside the shroud and the nozzle. This is accomplished by maintaining the ring of inert gas within an enclosure surrounding the nozzle adjacent the shroud's upper portion. The enclosure comprises structure for preventing the entry, into the clearance, of gas from the atmosphere around the shroud and the nozzle. This prevents outside air from entering the shroud at the junction.

Another feature of the present invention is the provision on the nozzle of structure defining a fixed, unvarying, vertical reference level for use in mounting the gas containment enclosure around the nozzle.

Other features and advantages are inherent in the method and apparatus claimed and disclosed or will become apparent to those skilled in the art from the following detailed description in conjunction with the accompanying diagrammatic drawings.

BRIEF DESCRIPTION OF THE DRAWINGS

FIG. 1 is a side view, partially in vertical section, illustrating an embodiment of the present invention;

FIG. 2 is an enlarged, fragmentary, vertical sectional view illustrating the upper portion of a shroud and the lower portion of a nozzle in accordance with the present invention;

FIG. 3 is an enlarged side view, partially in section, of the nozzle;

FIG. 4 is a further enlarged fragmentary sectional view of part of the nozzle;

FIG. 5 is an enlarged, vertical sectional view of the shroud;

DETAILED DESCRIPTION

Figure 6:
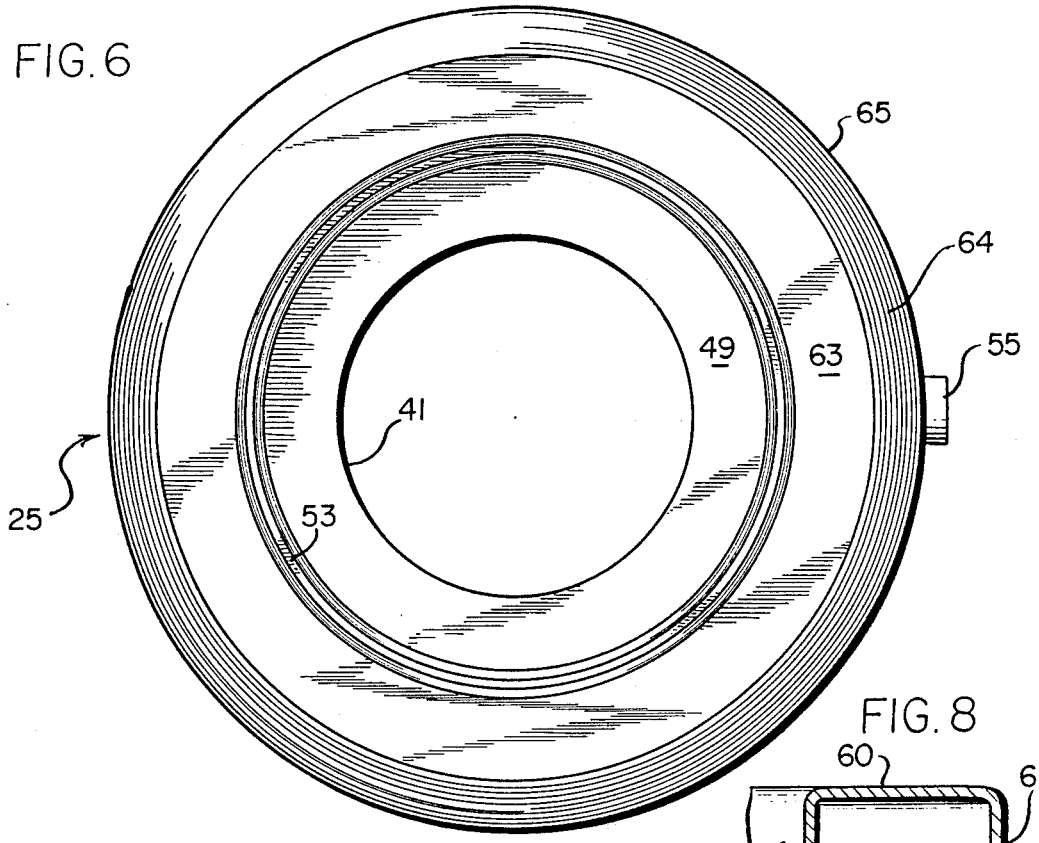
FIG. 6 is a plan view of the shroud.

Referring initially to FIG. 1, there is shown an upper container or ladle 20 having a bottom opening 21 closed by a gate 22. Gate 22 is of conventional construction and may be opened to allow the flow of molten metal, such as molten steel, from within ladle 20 outwardly through bottom opening 21 into a nozzle 24 communicating with a shroud 25 having a lower end 26 located below the top surface 27 of a bath 28 contained within a lower container such as a tundish 29 of a continuous casting apparatus of conventional construction.

In operation, a stream of molten metal descends from ladle 20 through nozzle 24 and shroud 25, which is vertically aligned with nozzle 24, into tundish 29. Both nozzle 24 and shroud 25 are tubular and both are vertically disposed.

Referring now to FIGS. 2–3, nozzle 24 includes a lower portion 31 comprising an outer metal jacket 32 surrounding an inner lining 33 composed of refractory material unspaced from jacket 32. Nozzle 24 also includes an upper portion 35 comprising an upward extension 36 of refractory lining 33 and a metal jacket 37 surrounding and spaced from refractory lining extension 36. The space between metal jacket 37 and refractory lining extension 36 is filled with refractory mortar 39 (FIG. 3), which bonds jacket 37 to lining extension 36 and fixes refractory lining 33 relative to jacket 37, forming a single, continuous piece comprising jacket 37 and lining 33.

With reference to FIGS. 2 and 5, shroud 25 comprises an outer metal jacket 40 surrounding an inner refractory lining 41 unspaced from jacket 40. Refractory lining 41 has a lower, unjacketed extension 42 terminating at the shroud's lower end 26.

Referring again to FIGS. 2 and 3, the nozzle's lower portion 31 has a top part 44, a bottom part 45 and an intermediate part 46 between top part 44 and bottom part 45. Bottom part 45 terminates at a nozzle lower end 47. As shown in FIGS. 2 and 5, shroud 25 has an annular upper portion 48 surrounding bottom part 45 of nozzle lower portion 31. Shroud upper portion 48 removably engages nozzle lower portion 31 at their junction, and this will be described in more detail below.

Located adjacent the shroud's annular upper portion 48 is an interior ledge 49 upon which is seated an annular pad or gasket 50 sandwiched between ledge 49 and lower end 47 of nozzle 24 when the nozzle's lower portion 31 is engaged by the shroud's annular upper portion 48 as shown in FIG. 2. There is an annular clearance 52 between the shroud's upper portion 48 and the surrounded bottom part 45 of the nozzle's lower portion 31 (FIG. 2). The junction, between shroud upper portion 48 and nozzle lower portion 31, is defined by annular clearance 52 and the space occupied by annular pad 50. Pad 50 is typically composed of graphite, but it may be composed of other suitable material which will perform the function of a gasket while withstanding the temperatures which prevail when molten metal descends through the nozzle and the shroud.

As shown in FIG. 2, the interior cross-section or diameter of shroud 25, below lower end 47 of nozzle 24, is greater than the interior cross-section or diameter of nozzle 24. As a result, a descending stream of molten metal which entirely fills the interior cross-section of nozzle 24 will not entirely fill the interior cross-section of shroud 25, and a partial vacuum will be created within the interior of shroud 25 by the descent of the molten metal stream therethrough. In the absence of some preventive expedient, the partial vacuum created within the interior of shroud 25 will aspirate outside air, from the atmosphere surrounding nozzle 24 and shroud 25, into the interior of shroud 25 through annular clearance 52 between the shroud's annular upper portion 48 and bottom part 45 of nozzle lower portion 31. This would be undesirable because it would allow the introduction of oxygen and nitrogen into the molten metal stream descending through the interior of shroud 25.

As noted above, annular graphite gasket 50 is sandwiched between lower end 47 of nozzle bottom part 45 and ledge 49 adjacent the shroud's upper annular portion 48, but the presence of gasket 50 will not entirely prevent the aspiration of outside air into the interior of shroud 25. Gasket 50 is not leakproof. Gas contained within clearance 52 can be aspirated past annular gasket 50 into the interior of shroud 25.

Moreover, even if the cross-sectional area (diameter) of shroud 25 were the same as that of nozzle 24, the downward movement of the stream of molten metal from nozzle 24 into shroud 25 would still create an aspirating effect at the seam between the bottom part 45 of nozzle lower portion 31 and upper annular portion 48 of shroud 25 where the latter engages the former.

The shroud's annular upper portion 48 has an interior recess 53 communicating with the inner end of a channel 54 having an outer end communicating with a coupling 55 for connecting channel 54 with a source of inert gas. Recess 53 communicates with clearance 52 located between the shroud's annular upper portion 48 and the bottom part 45 of the nozzle's lower portion 31. Recess 53 extends all the way around clearance 52. Channel 54 constitutes a gas passageway, and the inlet to channel 54 communicates with the exterior of the shroud's upper annular portion 48, when coupling 55 is disconnected from an external source of inert gas.

When inert gas is introduced through coupling 55 it flows through channel 54 and recess 53 into clearance 52 and impedes the entry of outside air into clearance 52. However, the introduction and replenishment of inert gas into clearance 52 would not entirely prevent outside air from entering the interior of shroud 25 through clearance 52. Eddy currents in the inert gas within clearance 52 allow the escape of inert gas into the outside atmosphere and the entry of air from the outside atmosphere into clearance 52 from where the air can be aspirated into the interior of shroud 25.

Figure 8:
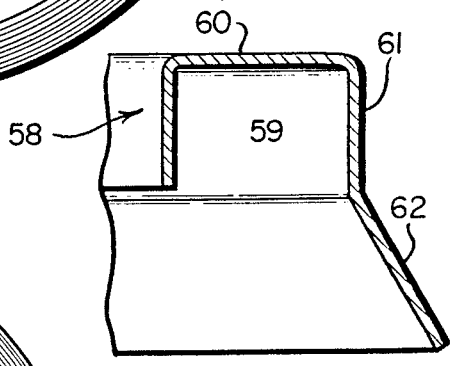
FIG. 8 is a sectional view taken along line 8—8 in FIG. 7.
Figure 7:
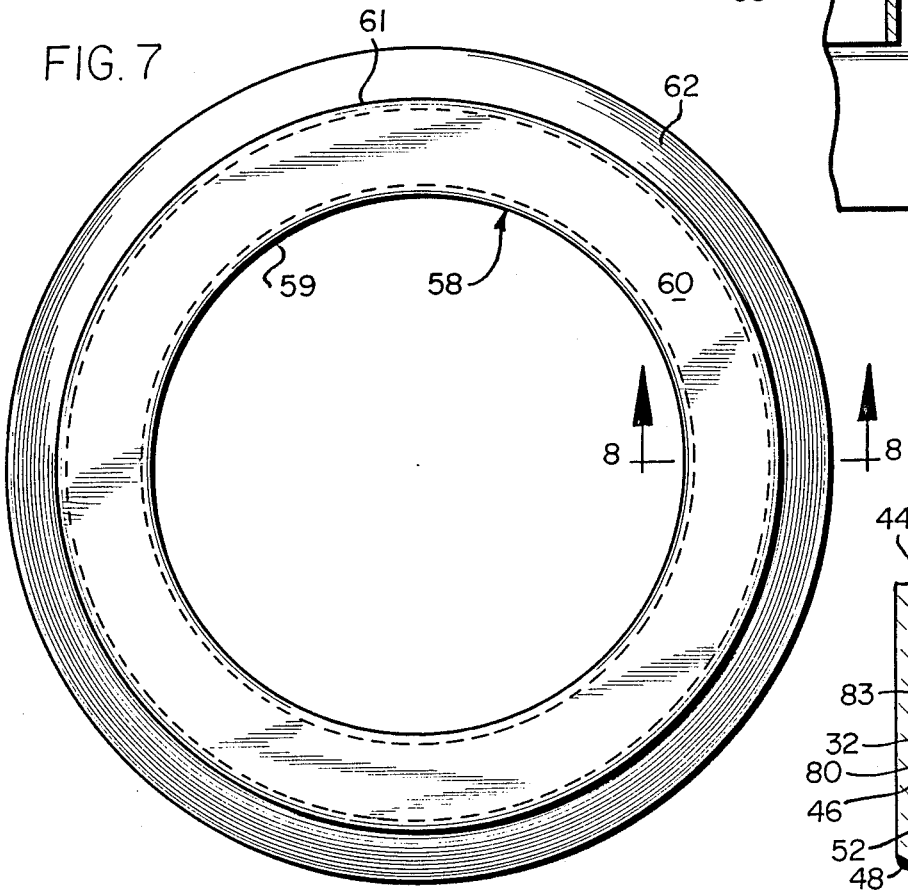
FIG. 7 is a plan view of a gas containment ring or enclosure in accordance with an embodiment of the present invention.

In accordance with the present invention, structure is provided to contain the inert gas within clearance 52 and to prevent outside air from entering clearance 52. More particularly, surrounding intermediate part 46 of nozzle lower portion 31 is a gas containment ring 58 (FIG. 2). As shown in FIGS. 2, 7 and 8, ring 58 is composed of metal and comprises an inner wall portion 59 integral with an upper wall portion 60 integral with an outer wall portion 61 integral with a skirt 62 which extends downwardly and outwardly relative to outer wall portion 61. Outer wall portion 61 on gas containment ring 58 extends between the ring's upper wall portion 60 and the shroud's annular upper portion 48. Inner wall portion 59 on gas containment ring 58 comprises structure for frictionally engaging metal jacket 32 at intermediate part 46 of nozzle lower portion 31.

Referring to FIGS. 2 and 5, metal jacket 40 on shroud 25 has a horizontally disposed top portion 63 which, together with wall portions 59–61 on ring 58, define a gas containment structure having an interior 67 communicating with clearance 52. Shroud jacket top portion 63 is integral with an exterior arcuate shoulder portion 64 integral with a vertical portion 65 on which coupling 55 is mounted.

When gas containment ring 58 is located in the position illustrated in FIG. 2, the ring's inner wall portion 59 engages metal jacket 32 on nozzle lower portion 31, and the ring's skirt 62, which extends downwardly and outwardly relative to interior 67 of the gas containment structure, tangentially engages arcuate shoulder porton 64 of the shroud's metal jacket to effect a seal. As shown in FIG. 2, the gas containment structure is devoid of any opening to the outside atmosphere around nozzle 24. Gas containment ring 58 is assembled in place around intermediate part 46 of nozzle lower portion 31 by sliding the ring upwardly from below the nozzle.

Ring 58 is positioned at a fixed vertical reference level on the nozzle, employing structure now to be described with reference to FIGS. 2–4. As noted above, nozzle upper portion 36 has a metal jacket 37 which in turn has a bottom part 38 to which is attached a metal ring 70 at a weldment 76 (FIG. 4), for example. Metal jacket 32 on nozzle lower portion 31 has an outwardly extending peripheral flange 34 located at top part 44 of the nozzle lower portion. Metal ring 70 defines an inwardly extending peripheral ledge 71 at the bottom part 38 of metal jacket 37. Ledge 71 comprises structure for seating peripheral flange 34 to support nozzle lower portion 31 and upward extension 36 of refractory lining 33. Ledge 71 defines a fixed, vertical, reference level for flange 34.

Metal ring 70 has a bottom surface 75 defining another fixed, vertical reference level on nozzle 24. When gas containment ring 58 is slid upwardly around intermediate part 46 of nozzle lower portion 31, the top surface on the ring's upper wall portion 60 abuts against bottom surface 75 of metal ring 70. In this manner, the vertical position of gas containment ring 58 is fixed in relation to nozzle 24.

After gas containment ring 58 has been assembled in place, around intermediate part 46 of nozzle lower portion 31 (FIG. 2), the shroud's upper annular portion 48 is engaged around the bottom part 45 of nozzle lower portion 31 by sliding the shroud's upper annular portion upwardly into telescoping relation with the bottom part of the nozzle's lower portion. Shroud 25 is held in engagement with nozzle 24 by a manipulator arm 77 having a pair of parallel, notched ears, only one of which is shown at 79 in FIG. 1, each engaging a respective pin 78 extending outwardly from vertical portion 65 of metal jacket 40 on shroud 25. This type of arrangement is described in greater detail in Rellis, et al., U.S. Pat. No. 4,747,584, and the disclosure thereof is incorporated herein by reference.

The arrangement described in the preceding paragraph mounts shroud 25 for pivotal movement, relative to nozzle 24, about a horizontal axis defined by pins 78. Clearance 52 accommodates the movement described in the preceding sentence. This movement may be initiated by currents or disturbances in bath 28 acting upon lower extension 42 of the shroud's refractory lining 41. Skirt 62 on gas containment ring 58 comprises structure for wiping arcuate shoulder portion 64 on the shroud's metal jacket 40, during pivotal movement of the shroud, for maintaining the seal for the inert gas ring around nozzle lower portion 31. The curvature on arcuate shoulder portion 64 facilitates maintenance of the seal by the wiping action of skirt 62 during pivotal movement of the shroud.

Metal ring 70, in addition to providing fixed, vertical, reference levels for ring 58 and flange 34 on the nozzle's lower portion 31, also functions to reinforce the nozzle.

Lower end 47 of nozzle 24 cannot be used as a fixed, vertical, reference level because end 47 can erode away during service. Similarly, the tip of metal jacket 32 on nozzle lower portion 31 adjacent the nozzle's lower end 47 cannot be used as a fixed, vertical, reference level because the metal jacket tip is subject to bending during usage. There is a need for a vertical reference level higher up on the nozzle than bottom part 45 of the nozzle's lower portion 31. A fixed, vertical, reference level on the nozzle itself is desirable in situations where, as here, a seal is effected on the nozzle itself. In apparatus of the type employed by the present invention, a seal is desirable at the location where the nozzle's lower portion 31 is engaged by the shroud's upper portion 48.

Metal jacket 37, to which reference ring 70 is attached, is in turn attached to a vertically fixed part 72 of gate 22. The embodiment of gate 22 illustrated in FIG. 1 is a reciprocating gate in which vertically fixed part 72 reciprocates horizontally back and forth, with nozzle 24 and shroud 25, under the urging of a pneumatic piston and cylinder arrangement indicated at 73 in FIG. 1. Gate part 72 is mounted for reciprocating movement relative to lower gate part 74 which is cut away at appropriate locations (not shown) to accommodate reciprocating movement of the nozzle's upper portion 35. As noted above, the gate shown in FIGS. 1 and 3 is of the reciprocating type. A rotary type gate could also be employed. However, whatever type of gate is employed, nozzle 24 and shroud 25 typically move together with the gate.

There are also arrangements in which nozzle 24 would be stationary relative to a movable gate element. All of the gate constructions described above are conventional and commercially available and do not constitute a part of the present invention.

In essence, gas containment ring 58 cooperates with the intermediate part of the nozzle's lower portion 31 and with the top of the shroud to provide a ring of inert gas around the nozzle, above and in communication with clearance 52, immediately adjacent the junction of the nozzle and the shroud. Preferably, the pressure of inert gas in the ring is maintained above the pressure of the atmosphere outside nozzle 24 and shroud 25, typically at least about 10% greater than atmospheric pressure. The inert gas is introduced directly into clearance 52 and enters the interior 67 of the gas containment ring by virtue of the communication between interior 67 and clearance 52.

Gas containment ring 58 is usable for more than one heat. However, typically, it is replaced after every heat.

Figure 9:
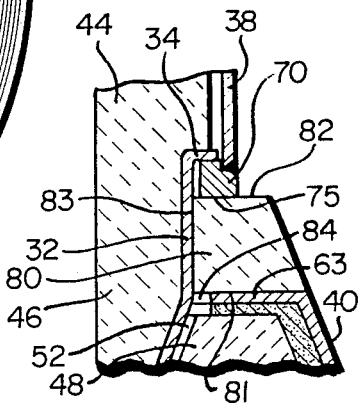
FIG. 9 is a fragmentary, vertical sectional view illustrating another embodiment of a gas containment structure in accordance with the present invention.

Referring now to FIG. 9, there is illustrated another embodiment of structure for containing gas within clearance 52 and preventing the entry into clearance 52 of outside air from the surrounding atmosphere. More particularly, surrounding the nozzle's intermediate part 46 is an annular, gas-sealing element or ring 80 composed of refractory material. Refractory ring 80 has a bottom portion 81 abutting the top portion 63 of the shroud's metal jacket 40, from above. Refractory ring 80 also has a top portion 82 abutting reference ring 70 from below and an inside portion 83 frictionally engaging metal jacket 32 of nozzle lower portion 31 at the latter's intermediate part 46. Bottom surface 75 of metal ring 70 defines a fixed, vertical, reference level for positioning refractory ring 80 around the nozzle's lower portion at intermediate part 46 thereof.

As shown in FIG. 2, clearance 52 is upwardly inclined and thus has a vertical component. Being vertically inclined, clearance 52 has upper and lower ends. In the embodiment of FIG. 2, the upper end of clearance 52 communicates with the interior 67 of gas containment ring 58. In the embodiment of FIG. 9, the lower portion 81 of refractory ring 80 comprises structure for closing the upper end 84 of clearance 52. In this manner, refractory ring 80 prevents the entry into clearance 52 of outside air from the atmosphere around shroud 25 and nozzle 24.

Refractory ring 80 is composed of a material such as silica fiber. Ring 80 is slid up into frictional engagement around intermediate part 46 of nozzle lower portion 31, in the same manner as metal ring 58. Refractory ring 80 is preferably replaced after each heat.

The metal jackets and refractory linings of nozzle 24 and shroud 25 are composed of materials conventionally used for those purposes.

The foregoing detailed description has been given for clearness of understanding only, and no unnecessary limitations should be understood therefrom, as modifications will be obvious to those skilled in the art.

We claim:

1. Apparatus for directing a vertically descending stream of molten metal from an upper container to a lower container, said apparatus comprising:

a vertically disposed nozzle having upper and lower portions;

a tubular shroud vertically aligned with said nozzle, below the nozzle's lower portion;

said shroud and said lower portion of the nozzle each comprising an outer metal jacket surrounding an inner lining of refractory material;

said upper portion of the nozzle comprising an upward extension of said refractory lining of the lower portion;

a further metal jacket surrounding and spaced from the refractory lining of the nozzle's upper portion, said further metal jacket having a bottom part;

a metal ring attached to said bottom part of said further metal jacket;

said lower portion of the nozzle having a top part, a bottom part and an intermediate part between said top and bottom parts;

said metal jacket on the nozzle's lower portion having an outwardly extending peripheral flange at said top part;

said metal ring defining an inwardly extending peripheral ledge at the bottom part of said further metal jacket;

said ledge comprising means for seating said peripheral flange to support the nozzle's lower portion thereon.

2. Apparatus as recited in claim 1 wherein:

said shroud has an annular upper portion surrounding the bottom part of the nozzle's lower portion;

there is an annular clearance between the shroud's upper portion and said surrounded bottom part of the nozzle's lower portion;

said apparatus comprises gas containment means surrounding said intermediate part of the nozzle's lower portion;

said gas containment means having an interior communicating with said clearance;

said apparatus comprises means for introducing a gas, from an outside source, into said clearance;

said gas containment means comprising means for preventing the entry of gas, from the atmosphere around said nozzle and said shroud, into said clearance.

3. Apparatus as recited in claim 2 wherein:

said metal ring has a bottom surface defining a first, fixed, vertical reference level on said nozzle.

4. Apparatus as recited in claim 3 wherein:

said gas containment means has a top surface abutting against said bottom surface of said metal ring.

5. Apparatus as recited in claim 2 wherein:

said metal jacket of the shroud has an arcuate exterior shoulder portion adjacent said gas containment means;

said gas containment means comprises a metal skirt extending downwardly and outwardly relative to the interior of the gas containment means;

said skirt comprises means for tangentially engaging the arcuate shoulder portion of the shroud's metal jacket to effect a seal.

6. Apparatus as recited in claim 5 and comprising:

means mounting said shroud for pivotal movement, relative to said nozzle, about a horizontal axis;

said skirt comprising means for wiping said arcuate shoulder portion of the shroud's metal jacket, during said pivotal movement, for maintaining said seal.

7. Apparatus as recited in claim 2 wherein said gas containment means is constructed of metal and comprises:

an upper wall portion abutting said metal ring from below;

an outer wall portion extending between said upper wall portion and said upper portion of the shroud;

and means for frictionally engaging the outer metal jacket on the lower portion of the nozzle.

8. Apparatus as recited in claim 1 wherein:

said metal ring has a top surface defining a second, fixed, vertical reference level on said nozzle;

and said peripheral flange rests on said top surface of the metal ring.

9. Apparatus for directing a vertically descending stream of molten metal from an upper container to a lower container, said apparatus comprising:

a nozzle;

a tubular shroud vertically aligned with said nozzle, below the nozzle;

said shroud and said nozzle each comprising an outer metal jacket and an inner refractory lining;

said nozzle having a bottom part;

said shroud having an annular upper portion surrounding the bottom part of the nozzle;

an annular clearance between the shroud's upper portion and said surrounded bottom part of the nozzle;

gas containment means surrounding said nozzle above the nozzle's bottom part;

said gas containment means having an interior communicating with said clearance;

and means for introducing a gas, from an outside source, into said clearance;

said gas containment means comprising means for preventing the entry of gas, from the atmosphere around said nozzle, into said clearance.

10. Apparatus as recited in claim 9 wherein:

said metal jacket of the shroud has an arcuate exterior shoulder portion adjacent said gas containment means;

said gas containment means comprises a metal skirt extending downwardly and outwardly relative to the interior of the gas containment means;

and said skirt comprises means for tangentially engaging the arcuate shoulder portion of the shroud's metal jacket to effect a seal.

11. Apparatus as recited in claim 10 and comprising:

means mounting said shroud for pivotal movement, relative to said nozzle, about a horizontal axis;

said skirt comprising means for wiping said arcuate shoulder portion of the shroud's metal jacket, during said pivotal movement, for maintaining said seal.

12. Apparatus as recited in claim 9 wherein said gas containment means is constructed of metal and comprises:

an upper wall portion;

an outer wall portion extending between said upper wall portion and said upper portion of the shroud;

and means for frictionally engaging the outer metal jacket on the nozzle.

13. Apparatus as recited in claim 12 and comprising:

said metal ring attached to and surrounding said nozzle;

said upper wall portion of the gas containment means abutting said metal ring from below.

14. Apparatus as recited in claim 9 wherein:

said upper annular portion of the shroud has an interior surface defining one surface of said annular clearance;

said interior surface has a recess extending all the way around said clearance;

and said apparatus comprises a gas passageway having an outlet communicating with said recess and an inlet communicating with the exterior of the shroud's upper annular portion.

15. Apparatus for directing a vertically descending stream of molten metal from an upper container to a lower container, said apparatus comprising:

a nozzle;

a tubular shroud vertically aligned with said nozzle, below the nozzle;

said shroud and said nozzle each comprising an inner refractory lining;

said nozzle having a bottom part;

said shroud having an annular upper portion surrounding the bottom part of the nozzle;

an annular clearance between the shroud's upper portion and said surrounded bottom part of the nozzle;

means for introducing a gas from an outside source into said clearance;

annular gas-sealing means surrounding said nozzle above the nozzle's bottom part;

said sealing means having a bottom portion abutting the upper portion of said shroud from above;

said sealing means being composed of refractory material and comprising means for preventing the entry into said clearance, of gas from the atmosphere around said nozzle and said shroud;

an outer metal jacket on said nozzle;

said gas-sealing means comprising means for frictionally engaging the outer metal jacket on said nozzle.

16. Apparatus as recited in claim 15 and comprising:

a metal ring attached to and surrounding said nozzle;

said metal ring having a bottom surface defining a fixed, vertical reference level on said nozzle;

said sealing means having a top portion abutting said bottom surface of the metal ring from below.

17. Apparatus as recited in claim 15 wherein:

said clearance has a vertical component, a lower end and an upper end;

and sealing means comprising means for closing said upper end of the clearance.

18. In a process wherein a stream of molten metal flows downwardly, toward a molten metal bath, through a vertically disposed nozzle having a bottom part, and then through tubular shroud vertically aligned with said nozzle below the nozzle, said shroud having an annular upper portion surrounding the nozzle's bottom part and a lower end extending below the top surface of said molten metal bath, there being an annular clearance between the shroud's upper portion and the surrounded bottom part of the nozzle, and wherein said stream of molten metal descending through said shroud reduces the pressure within said shroud to a level below the pressure in the atmosphere outside said shroud, a method for preventing air in the atmosphere outside said nozzle and said shroud from being aspirated into the interior of said shroud through said clearance, said method comprising the steps of:

introducing an inert gas into said clearance;

providing a ring of said inert gas around said nozzle adjacent said clearance and in communication with said inert gas in the clearance;

maintaining the pressure of said inert gas in said ring above the pressure of the atmosphere outside said shroud;

preventing the escape of said inert gas from said clearance and said ring into the outside atmosphere around said nozzle, and preventing the entry into said clearance of air from said outside atmosphere when there are eddy currents in the inert gas within said clearance.

19. In a process as recited in claim 18 wherein said step of providing said ring of inert gas comprises:

containing said ring within an enclosure surrounding said nozzle adjacent the shroud's upper portion.

20. In a process as recited in claim 18 wherein:

said inert gas pressure in said ring is at least about 10% greater than the pressure in the atmosphere outside said shroud.

21. In a process as recited in claim 19 and comprising:

avoiding, in said ring-containing enclosure, any opening to the outside atmosphere around said nozzle.

22. Apparatus for directing a vertically descending stream of molten metal from an upper container to a lower container, said apparatus comprising:

a vertically disposed nozzle;

a tubular shroud vertically aligned with said nozzle, below the nozzle;

said nozzle having a bottom part;

said shroud having an upper portion surrounding the bottom part of the nozzle;

an annular clearance between the shroud's upper portion and said surrounded bottom part of the nozzle;

means for introducing an inert gas into said clearance;

and means for preventing the escape of said inert gas from said clearance into the outside atmosphere around said nozzle and for preventing the entry of gas, from said outside atmosphere, into said clearance, when there are eddy currents in the inert gas within said clearance.

23. Apparatus as recited in claim 22 wherein said preventing means comprises:

gas containment means surrounding said nozzle adjacent said clearance;

said gas containment means having an interior communicating with said clearance.

24. Apparatus as recited in claim 22 wherein said preventing means comprises:

gas containment means surrounding said nozzle adjacent said clearance;

said gas containment means being devoid of any opening to the outside atmosphere around said nozzle.

* * * * *